US007637726B2

(12) United States Patent
Ohmi

(10) Patent No.: US 7,637,726 B2
(45) Date of Patent: Dec. 29, 2009

(54) SCREW VACUUM PUMP

(75) Inventor: Tadahiro Ohmi, Miyagi (JP)

(73) Assignee: Tohoku University, Sendai-Shi (JP)

( * ) Notice: Subject to any disclaimer, the term of this patent is extended or adjusted under 35 U.S.C. 154(b) by 49 days.

(21) Appl. No.: 11/629,705

(22) PCT Filed: Jun. 17, 2005

(86) PCT No.: PCT/JP2005/011112

§ 371 (c)(1),
(2), (4) Date: Dec. 15, 2006

(87) PCT Pub. No.: WO2005/124155

PCT Pub. Date: Dec. 29, 2005

(65) Prior Publication Data

US 2007/0207050 A1 Sep. 6, 2007

(30) Foreign Application Priority Data

Jun. 18, 2004 (JP) ..... 2004-181854

(51) Int. Cl.
*F04C 18/00* (2006.01)
*F04C 2/00* (2006.01)

(52) U.S. Cl. ..... 418/201.3; 418/9; 418/189; 418/201.1

(58) Field of Classification Search ..... 418/15, 418/201.1, 20.13, 189, 190, 201.3, 9
See application file for complete search history.

(56) References Cited

U.S. PATENT DOCUMENTS 5,533,887 A 7/1996 Maruyama et al.
6,257,854 B1 7/2001 Fang et al.
6,359,411 B1 3/2002 Kösters et al.
6,371,744 B1 * 4/2002 Mito et al. ..... 418/201.3
2006/0216189 A1 9/2006 Ohmi

FOREIGN PATENT DOCUMENTS

| | | |
|---|---|---|
| GB | 2 030 227 | 4/1980 |
| JP | 55-043288 | 3/1980 |
| JP | 6-307360 | 11/1994 |
| JP | U3073810 | 9/2000 |
| JP | 2001-055992 A | 2/2001 |
| JP | 2001-214874 A | 8/2001 |
| JP | 2004-263629 A | 9/2004 |

* cited by examiner

*Primary Examiner*—Theresa Trieu
(74) *Attorney, Agent, or Firm*—Foley & Lardner LLP

(57) ABSTRACT

A screw vacuum pump includes a gas working chamber formed by a male screw rotor and a female screw rotor respectively including unequal lead screws engaging each other and having a lead angle that continuously changes with the advance of helix and a stator receiving therein both rotors. The stator is provided with a gas inlet port and a gas outlet port that can communicate with one end portion and the other end portion of the working chamber, respectively. The male screw rotor and the female screw rotor have unequal lead screws each of which is formed into a perpendicular-to-axis cross-sectional shape that changes following a continuous change in lead angle with the advance of helix. Alternatively, one of the male screw rotor and the female screw rotor has the unequal lead screw formed into a perpendicular-to-axis cross-sectional shape that is constant. Another has the unequal lead screw formed into a perpendicular-to-axis cross-sectional shape that changes. By this, an engagement gap between the unequal lead screws from the suction side to the discharge side is made constant.

8 Claims, 3 Drawing Sheets

[FIG. 1]
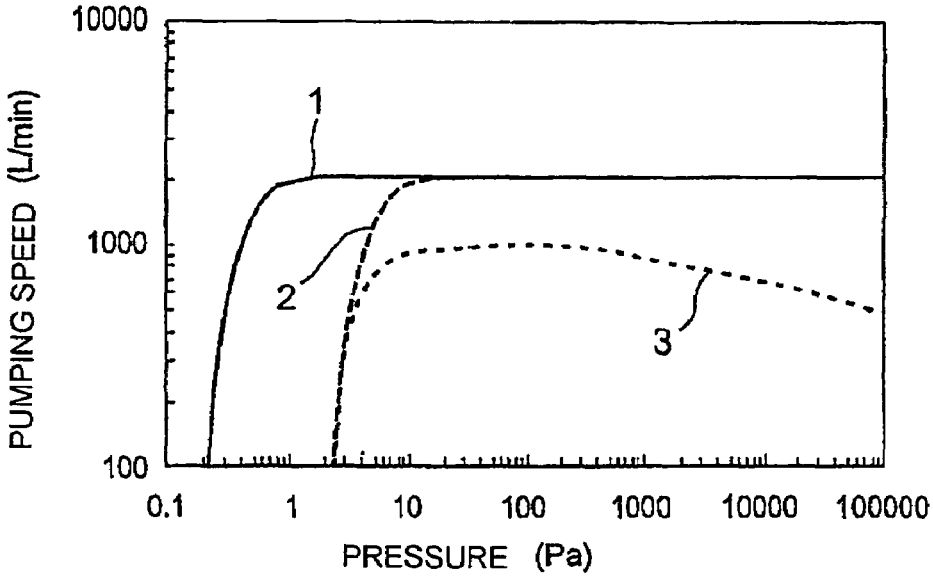
[FIG. 2]
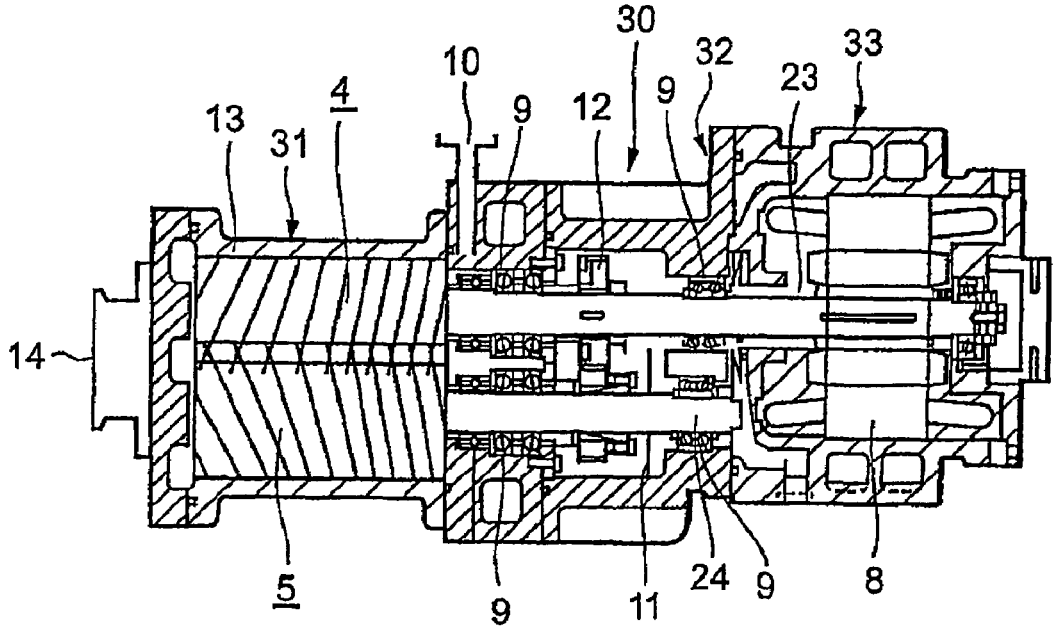

[FIG. 3]
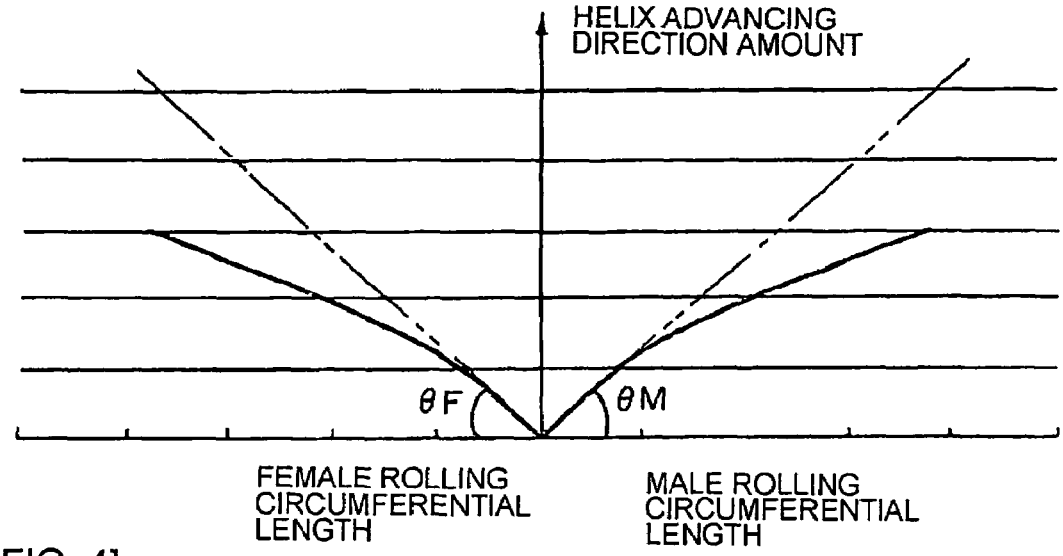
[FIG. 4]
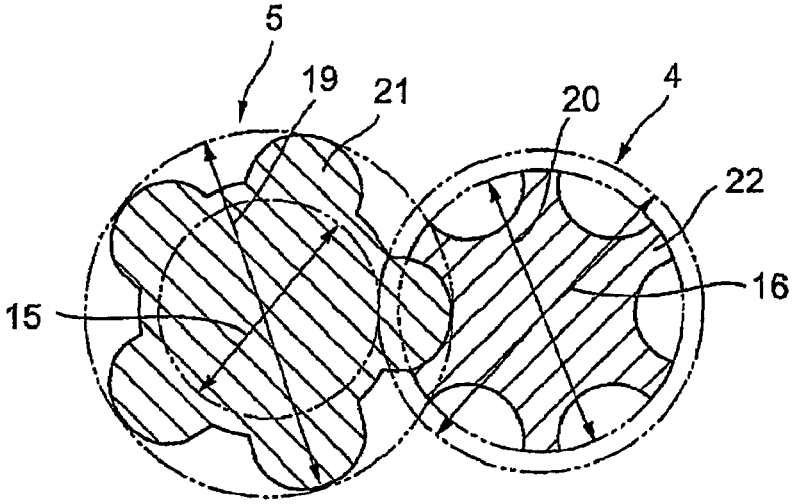

[FIG. 5]
(a)
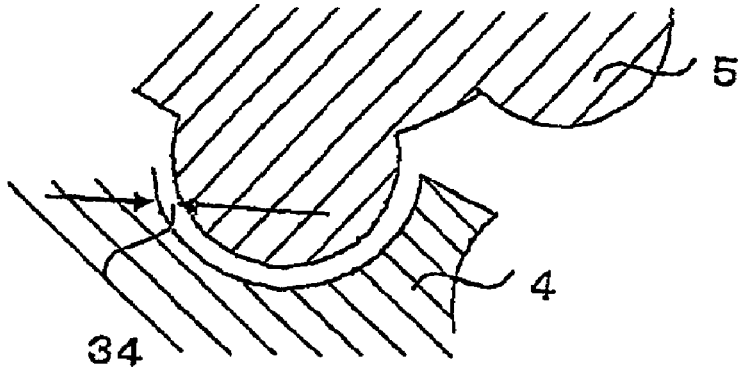
(b)
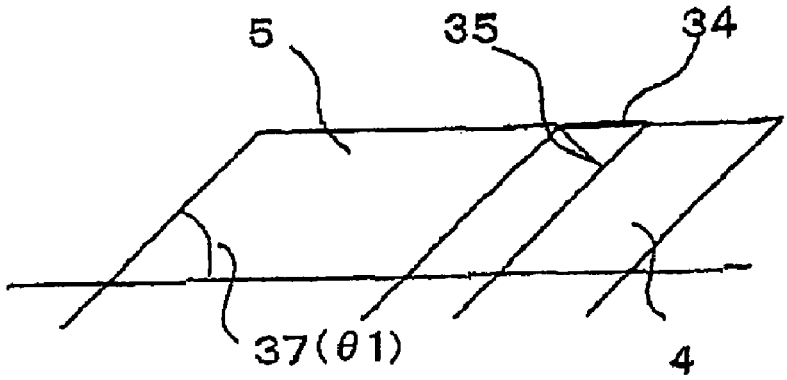
(c)
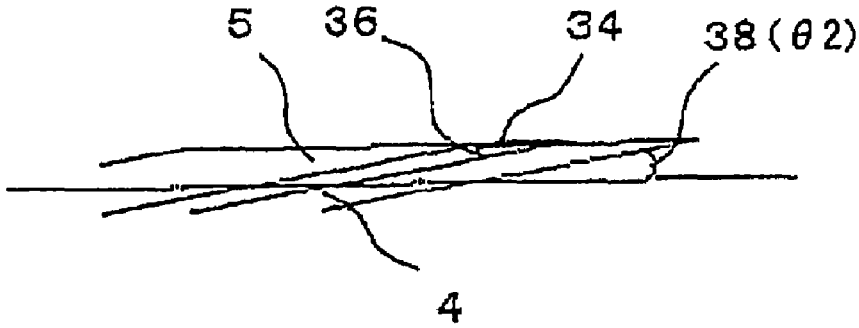

SCREW VACUUM PUMP

TECHNICAL FIELD

This invention relates to a screw vacuum pump and, in particular, to a screw vacuum pump that is optimal for a region from atmospheric pressure to 0.1 Pa.

BACKGROUND ART

In a semiconductor device manufacturing system, a serious problem arises in a semiconductor device manufacturing process if there occurs oil backflow from a pump into a process chamber of the semiconductor device manufacturing system. Accordingly, use has conventionally been made of a so-called dry pump, a mechanical booster pump, a turbomolecular pump, and the like in which there is no occurrence of contact between suction gas and oil.

With respect to these dry pump, mechanical booster pump, screw pump, etc., a problem exists that shaft seals are provided at both ends, i.e. on the suction side and the discharge side, and particularly a seal gas amount of the shaft seal on the suction side and a leakage amount from the seal cause a reduction in pumping speed, so that there is no alternative but to use such a pump that has an unnecessarily high pumping speed.

Further, since molecular weights of process gas, carrier gas, generated gas, and so on are broad, i.e. from 1 to one hundred and several tens, the current situation is on that the foregoing pumps are selectively used depending on their pumping characteristics for those various gases and their inherent pumping regions.

On the other hand, a problem exists that since the pumping speed is lowered depending on the kind of gas to be exhausted, a pump having a large pumping speed is inefficiently used. Further, with respect to general dry pumps and mechanical booster pumps, a problem exists that product is deposited inside the pump between an inlet port and an outlet port.

The present inventor has proposed a screw vacuum pump in Patent Document 1. The screw pump proposed in Patent Document 1 has a structure in which equal leads are provided on the suction side and the discharge side of unequal leads.

Patent Document 1

Japanese Unexamined Patent Application Publication (JP-A) No. 2004-263629

DISCLOSURE OF THE INVENTION

Problem to be Solved by the Invention

Therefore, this invention has been made to solve the foregoing problems and has an object to provide a screw vacuum pump that can maintain the stable pumping performance down to about 0.1 Pa regardless of the kind of gas.

Means for Solving the Problem

For accomplishing the foregoing object, according to one aspect of this invention there is provided a screw vacuum pump which comprises a gas working chamber formed by a male rotor and a female rotor respectively comprising unequal lead screws engaging each other and having a lead angle that continuously changes with the advance of helix and a stator receiving therein both rotors, and a gas inlet port and a gas outlet port provided at the stator so as to be capable of communicating with one end portion and the other end portion of the working chamber, respectively. In the screw vacuum pump, each of the unequal lead screws of the male rotor and the female rotor have the unequal lead screws each of which has a perpendicular-to-axis cross-sectional shape that changes following a continuous change in lead angle with the advance of helix.

Further, according to another aspect of this invention there is provided a screw vacuum pump which comprises a gas working chamber formed by a male rotor and a female rotor respectively comprising unequal lead screws engaging each other and having a lead angle that continuously changes with the advance of helix and a stator receiving therein both rotors, and a gas inlet port and a gas outlet port provided at the stator so as to be capable of communicating with one end portion and the other end portion of the working chamber, respectively. In the screw vacuum pump, the unequal lead screw of one of the male rotor and the female rotor has a perpendicular-to-axis cross-sectional shape that changes following a continuous change in lead angle with the advance of helix while the unequal lead screw of the other of the male rotor and the female rotor has a perpendicular-to-axis cross-sectional shape that is constant regardless of the change in lead angle.

As described above, the screw vacuum pump according to this invention changes the perpendicular-to-axis cross-sectional shape/shapes of one or both of the male and female rotors following a change in lead angle of the male and female rotors so as to make an engagement gap constant to reduce a conductance of an engagement portion, thereby suppressing back diffusion and largely improving the compression ratio. As a result, it is possible to maintain the stable pumping performance down to 0.1 Pa or less regardless of the kind of gas.

Effect of the Invention

According to this invention, the pumping speed of the screw vacuum pump is largely improved and hence it is possible to provide the screw vacuum pump that can efficiently achieve the stable pumping speed from atmospheric pressure to 0.1 Pa by the use of the single vacuum pump, thereby covering the wide operation range.

Further, by using the screw vacuum pump of this invention, it is possible to provide the screw vacuum pump that can constitute a vacuum system that is simpler in structure and lower in price as compared with a conventional vacuum system combining a dry pump, a mechanical pump, and so on.

Further, according to this invention, it is possible to provide the screw vacuum pump that can make a control system simple and inexpensive because, since the structure of the vacuum system is simplified, complicated operation such as valve switching becomes unnecessary.

BRIEF DESCRIPTION OF THE DRAWINGS

[FIG. 1] is a diagram showing a comparison in pumping speed between a conventional pump and a pump according to this invention.

[FIG. 2] is a sectional view showing the overall structure of a screw vacuum pump according to an embodiment of this invention.

[FIG. 3] is a developed view on base cylinders according to one example of this invention, wherein tooth helix curves of tooth-shaped external contact portions in the form of parabolas (quadratic curves) are shown on the coordinate axes in which the axis of abscissas represents male and female rolling circumferential lengths of the base cylinders and the axis of ordinates represents a helix advancing direction amount.

[FIG. 4] is a perpendicular-to-axis cross-sectional view of screws according to the embodiment of this invention.

[FIG. 5] is a diagram showing that a screw engagement gap changes due to a lead angle.

DESCRIPTION OF SYMBOLS

4 female screw rotor
5 male screw rotor
8 motor
9 bearing
10 outlet port
11 oil splashing mechanism
12 timing gear
13 stator
14 inlet port
15 gear engagement pitch circle of the male screw
16 gear engagement pitch circle of the female screw
19 male screw outer diameter
20 female screw outer diameter
21 male screw teeth
22 female screw teeth
23 first shaft
24 second shaft
30 screw vacuum pump
31 first housing
32 second housing
33 third housing

BEST MODE FOR CARRYING OUT THE INVENTION

In order to facilitate understanding of this invention, drawbacks of a conventional screw pump will be explained with reference to FIG. 1 before describing an embodiment of this invention.

Referring to FIG. 1, in the conventional screw vacuum pump, since a back-diffusion amount from an outlet port and a back-diffusion amount of diluent gas are large, the ultimate pressure becomes about 3 Pa and, as indicated by a curve 2 in FIG. 1, the pumping speed largely decreases on the molecular flow region side. Further, the pumping speed for hydrogen becomes ⅓ to ½ of that for nitrogen and, as indicated by a curve 3 in FIG. 1, since the compression ratio is small, the pumping speed extremely decreases. As one means for solving such drawbacks, the present inventor has proposed the screw vacuum pump in Patent Document 1. The screw pump proposed in Patent Document 1 has the structure in which the equal leads are provided on the suction side and the discharge side of the unequal leads.

Now, this invention will be described with reference to FIGS. 2 to 6.

Referring to FIG. 2, a screw vacuum pump 30 has a structure in which a first housing 31, a second housing 32, and a third housing 33 are connected in an axial direction in the order named from the pump side.

The first housing 31 comprises a stator 13 and has one end side provided with an inlet port 14 for sucking a fluid and the other end side communicating with the second housing 32. At a connecting portion, with the first housing 31, of the second housing 32, an outlet port 10 is provided for discharging the fluid. In the stator 13 of the first housing 31, a female screw rotor and a male screw rotor are disposed for engaging each other and using, as their rotation shafts, a first shaft 23 and a second shaft 24.

In the second housing 32, the first shaft 23 and the second shaft 24 are provided in the axial direction from the respective screw rotors disposed in the first housing 31. The first shaft 23 serves as the rotation shaft of the female screw rotor 4 and extends into the third housing 33. The second shaft 24 serves as the rotation shaft of the male screw rotor 5. The first shaft 23 and the second shaft 24 are rotatable by the use of bearings 9 disposed at both ends of the respective shafts in the second housing 32.

An oil splashing mechanism 11 is disposed around the second shaft 24 in the second housing 32 and intermeshing timing gears 12 are provided at substantially the same positions in the axial direction of the first shaft 23 and the second shaft 24.

In the third housing 33, an electric motor 8 is disposed which uses one end of the first shaft 23 as its rotation shaft.

The first shaft 23 held by the bearings 9 is rotated by the motor 8 disposed in the third housing 33 and this rotation synchronously rotates the first and second shafts 23 and 24 through the timing gears 12. The oil splashing mechanism 11 is attached to the second shaft 24 for supplying oil to the timing gears 12 and the bearings 9.

On the pump side, a high vacuum is achieved by high-speed rotation of the screw rotors comprising the female screw rotor 4 and the male screw rotor 5.

FIG. 3 shows tooth rolling curves of unequal lead screws in this invention. As shown in FIG. 3, a lead angle (θM, θF) of the screws continuously changes.

According to this invention, as shown in FIGS. 4 and 5, the screw vacuum pump is adapted to continuously reduce the volume between leads of the intermeshing female and male screw rotors 4 and 5 to thereby form a working chamber serving to compress gas, in order to suppress back diffusion from screw engagement forming the gas compressing working chamber. The perpendicular-to-axis cross-sectional shapes of the female and male screws 4 and 5 change as the lead angle (θM, θF) of the screws changes, thereby causing engagement gaps 35 and 36 to have a constant value/or the perpendicular-to-axis cross-sectional shape of one of the screws 4 and 5 changes as the lead angle (θM, θF) changes. On the other hand the perpendicular-to-axis cross-sectional shape of the other of the screws 4 and 5 does not change, i.e. is made constant, thereby causing engagement gaps 34 and 35 to have a constant value.

An important point herein lies in that if an engagement gap 34 in the screw perpendicular-to-axis cross-sectional shapes is made constant, the engagement gap 35 increases as the screw lead angle (θM, θF) increases. Thus, the back diffusion from the outlet port 10 cannot be suppressed by reducing the compression ratio of the screw vacuum pump and the back-diffused gas enters the working chamber and is again compressed and exhausted, thereby increasing the power consumption.

The increase in back diffusion largely affects the ultimate pressure and the pumping speed. Further, since the back diffusion causes compression and exhaust even at final leads, expansion and deformation occur due to compression heat near the outlet port to thereby cause contact between the screws and between the screws and the stator.

The suppression of the back diffusion leads to improvement in pumping performance and power saving.

Now, the specific example of the screw vacuum pump according to this invention will be described in further detail with reference to FIGS. 3 to 6.

FIG. 3 shows tooth rolling curves in the form of parabolas (quadratic curves) on the coordinate axes in which the axis of abscissas represents male and female rolling circumferential lengths of base cylinders and the axis of ordinates represents a helix advancing amount. FIG. 4 is a perpendicular-to-axis cross-sectional view of the male and female screws. Further, FIGS. 5(*a*), (*b*), and (*c*) show the relationship between a lead angle and an engagement gap when the perpendicular-to-axis cross-sectional shapes are unchanged. Herein, it is assumed that the engagement gap 34 is set constant in perpendicular-to-axis cross sections of the female screw rotor 4 and the male screw rotor 5, and the perpendicular-to-axis cross-sectional shapes thereof do not change even when the lead angle changes.

As one example thereof, a suction-side lead angle 37, with the best suction efficiency, is set to 45°, an engagement gap between the female screw rotor 4 and the male screw rotor 5, necessary for suppressing back diffusion from the outlet port, is set to 50 μm, and a discharge-side lead angle 38 is set to 10°. When the discharge-side engagement gap is set to 50 μm, an engagement gap between the female screw rotor 4 and the male screw rotor 5 at the suction-side lead angle 37 is (50/sin 10°)×sin 45°=203.6 μm. In this case, the perpendicular-to-axis cross-sectional engagement gap 34 is given by (50/sin 10°).

Based on this assumption, the engagement gaps 35 and 36 between the female screw rotor 4 and the male screw rotor 5 on the suction side becomes 203.6 μm, i.e. about four times 50 μm on the discharge side, and hence it becomes difficult to suppress the back diffusion, which is thus not preferable.

Therefore, in this invention, it is configured such that the female screw rotor 4 and the male screw rotor 5 have the perpendicular-to-axis cross-sectional shapes which changes following a continuous change in lead angle with the advance of helix of the rotors 4 and 5, thereby causing the screw rotor engagement gap 35, 36 to be constant from the suction side to the discharge side. With this configuration, assuming that the perpendicular-to-axis cross-sectional engagement gaps 34 on the suction side and the discharge side are set to L1 and L2, respectively, following a lead angle, the screw rotor engagement gap 35, 36 can be made constant from the suction side to the discharge side by providing perpendicular-to-axis cross-sectional shapes each satisfying L1·sin 10°=L2·sin 45°=a constant value (50 μm or less).

As described above, in the embodiment of this invention, the effect is achieved that the pumping speed of the screw vacuum pump is largely improved as indicated by a curve 1 in FIG. 1 so that the stable pumping speed can be obtained efficiently from atmospheric pressure to 0.1 Pa by the use of the single vacuum pump, thereby covering the wide operation range.

INDUSTRIAL APPLICABILITY

As described above, the screw vacuum pump according to this invention is optimal, as a normal vacuum pump, particularly in the structure of a vacuum system for a process chamber in a semiconductor device manufacturing system, as an exhaust vacuum pump, or the like.

The invention claimed is:

1. A screw vacuum pump comprising a gas working chamber formed by a male rotor, a female rotor and a stator, wherein:

said male rotor and said female rotor each comprises unequal lead screws engaging each other and having a lead angle that continuously changes with the advance of helix, said stator receiving therein both rotors, gas inlet and gas outlet ports are provided at said stator so as to communicate with one end portion and the other end portion of said gas working chamber, respectively, each of said unequal lead screws of said male rotor and said female rotor has a perpendicular-to-axis cross-sectional shape that changes following a continuous change in lead angle with the advance of helix, said male rotor and said female rotor have a gap therebetween in the perpendicular-to-axis cross-sectional shapes, said gap being formed so as to be gradually narrowed as moving from a discharge side to a suction side, and both of said male rotor and said female rotor have the perpendicular-to-axis cross-sectional shapes changed in accordance with the change in lead angle of said male and female rotors so as to make an engagement gap constant to reduce a conductance of an engagement portion, thereby suppressing back diffusion and largely improving a compression ratio.

2. A screw vacuum pump according to claim 1, wherein said male rotor and said female rotor have the numbers of teeth different from each other in the perpendicular-to-axis cross-sectional shapes.

3. A screw vacuum pump according to claim 1, wherein each of said male rotor and said female rotor has the perpendicular-to-axis cross-sectional shape which is formed so as to gradually increase its area as moving in an axial direction from a discharge side to a suction side.

4. A screw vacuum pump comprising a gas working chamber formed by a male rotor, a female rotor and a stator, wherein:

said male rotor and said female rotor each comprises unequal lead screws engaging each other and having a lead angle that continuously changes with the advance of helix, said stator receiving therein both rotors, gas inlet and gas outlet ports are provided at said stator so as to communicate with one end portion and the other end portion of said gas working chamber, respectively, each of said unequal lead screws of said male rotor and said female rotor has a perpendicular-to-axis cross-sectional shape that changes following a continuous change in lead angle with the advance of helix, said male rotor and said female rotor have a gap therebetween in the perpendicular-to-axis cross-sectional shapes, said gap being formed so as to be gradually narrowed as moving from a discharge side to a suction side, and when a lead angle of said male and female rotors on a suction side is set to θ1, a lead angle thereof on a discharge side is set to θ2, and engagement gaps between said male and female rotors in the perpendicular-to-axis cross-sectional shapes on the suction side and the discharge side are set to L1 and L2, respectively, the cross-sectional shapes are configured such that engagement gaps between said male and female rotors on the suction side and the discharge side satisfy L1 sin θ1=L2 sin θ2=a constant value.

5. A screw vacuum pump comprising a gas working chamber formed by a male rotor, a female rotor, and a stator, said male rotor and said female rotor comprising unequal lead screws engaging each other and having a lead angle that continuously changes with the advance of helix, said stator receiving therein both rotors; and gas inlet and gas outlet ports provided at said stator so as to communicate with one end portion and the other end portion of said working chamber, respectively, wherein:

said unequal lead screw of one of said male rotor and said female rotor has a perpendicular-to-axis cross-sectional shape that changes following a continuous change in lead angle with the advance of helix and said unequal lead screw of the other of said male and female rotor has a perpendicular-to-axis cross-sectional shape that is constant regardless of the change in lead angle, said male rotor and said female rotor have a gap therebetween in the perpendicular-to-axis cross-sectional shapes which are formed so as to be gradually narrowed as moving from a discharge side to a suction side, and both of said male rotor and said female rotor have the perpendicular-to-axis cross-sectional shapes changed in accordance with the change in lead angle of said male and female rotors so as to make an engagement gap constant to reduce a conductance of an engagement portion, thereby suppressing back diffusion and largely improving a compression ratio.

6. A screw vacuum pump according to claim 5, wherein said male rotor and said female rotor have the numbers of teeth different from each other in the perpendicular-to-axis cross-sectional shapes.

7. A screw vacuum pump according to claim 5, wherein said one of said male rotor and said female rotor is formed into the perpendicular-to-axis cross-sectional shape of is formed so as to gradually increase its area as moving in an axial direction from a discharge side to a suction side.

8. A screw vacuum pump according to claim 5, wherein when a lead angle of said male and female rotors on a suction side is set to $\theta 1$, a lead angle thereof on a discharge side is set to $\theta 2$, and engagement gaps between said male and female rotors in the perpendicular-to-axis cross-sectional shapes on the suction side and the discharge side are set to L1 and L2, respectively, the cross-sectional shapes are configured such that engagement gaps between said male and female rotors on the suction side and the discharge side satisfy $L1 \sin \theta 1 = L2 \sin \theta 2$=a constant value.

* * * * *